US009407070B2

(12) United States Patent
Takemoto et al.

(10) Patent No.: US 9,407,070 B2
(45) Date of Patent: Aug. 2, 2016

(54) IGNITION SYSTEM AND IGNITION PLUG THAT REDUCES THE REQUIRED VOLTAGE TO SUSTAIN AN ENGINE, WHILE IMPROVING IGNITION PERFORMANCE AND COMBUSTABILITY

(71) Applicants: YANMAR CO., LTD., Osaka-shi, Osaka (JP); Nagoya Institute of Technology, Nagoya-shi, Aichi (JP)

(72) Inventors: Toru Takemoto, Osaka (JP); Kazuteru Toshinaga, Osaka (JP); Ryoichi Hagiwara, Osaka (JP); Masahiro Furutani, Nagoya (JP)

(73) Assignees: YANMAR CO., LTD., Osaka-shi (JP); NAGOYA INSTITUTE OF TECHNOLOGY, Nagoya-shi (JP)

( * ) Notice: Subject to any disclaimer, the term of this patent is extended or adjusted under 35 U.S.C. 154(b) by 0 days.

(21) Appl. No.: 14/773,789

(22) PCT Filed: Jan. 20, 2014

(86) PCT No.: PCT/JP2014/050959

§ 371 (c)(1),
(2) Date: Sep. 9, 2015

(87) PCT Pub. No.: WO2014/148083

PCT Pub. Date: Sep. 25, 2014

(65) Prior Publication Data

US 2016/0020583 A1 Jan. 21, 2016

(30) Foreign Application Priority Data

Mar. 19, 2013 (JP) ..... 2013-056471

(51) Int. Cl.

| | |
|---|---|
| ***H01T 13/46*** | (2006.01) |
| ***F02P 3/02*** | (2006.01) |
| ***F02P 5/00*** | (2006.01) |
| ***H01T 13/20*** | (2006.01) |
| *F02P 9/00* | (2006.01) |

(52) U.S. Cl.
CPC ..... *H01T 13/467* (2013.01); *F02P 3/02* (2013.01); *F02P 5/00* (2013.01); *H01T 13/20* (2013.01); *F02P 9/007* (2013.01)

(58) Field of Classification Search
CPC ..... H01T 13/467; H01T 13/20; F02P 5/00; F02P 3/02; F02P 9/007
USPC ..... 313/141
See application file for complete search history.

(56) References Cited

U.S. PATENT DOCUMENTS 6,796,299 B2 * 9/2004 Isono ..... H01T 13/467 123/169 EL
7,628,130 B2 * 12/2009 Johng ..... H01T 13/20 123/169 EL (Continued)

FOREIGN PATENT DOCUMENTS

| | | |
|---|---|---|
| GB | 2030643 A | 4/1980 |
| JP | S61-127591 U | 8/1986 |
| JP | H05-272441 A | 10/1993 |

(Continued)

OTHER PUBLICATIONS

Translation of International Search Report, Jan. 2014.*

*Primary Examiner* — Tracie Y Green
(74) *Attorney, Agent, or Firm* — Mots Law, PLLC

(57) ABSTRACT

An engine ignition system and the like are provided, which reduce a required voltage and improve an ignition performance without any special electrical configuration. An ignition system is configured so that: to an auxiliary electrode is applied a voltage that is not more than a voltage applied between a center electrode and a ground electrode and that generates no spark discharge; the auxiliary electrode is positioned so that an electric field Ef2 between the auxiliary electrode and the ground electrode or an electric field Ef3 between the auxiliary electrode and the center electrode, which is generated by the applied voltage, is spread over the gap. A time for applying the voltage to the auxiliary electrode is controlled to include a time for applying the voltage between the center electrode and the ground electrode.

4 Claims, 7 Drawing Sheets

(56) References Cited

U.S. PATENT DOCUMENTS

2008/0000441 A1 1/2008 Jun
2010/0187968 A1 7/2010 Ikeda et al.

FOREIGN PATENT DOCUMENTS

JP 2007-032349 A 2/2007
JP 2009-038026 A 2/2009

* cited by examiner

IGNITION SYSTEM AND IGNITION PLUG THAT REDUCES THE REQUIRED VOLTAGE TO SUSTAIN AN ENGINE, WHILE IMPROVING IGNITION PERFORMANCE AND COMBUSTABILITY

TECHNICAL FIELD

The present invention relates to an ignition system of an internal combustion engine, an ignition plug capable of being used in the ignition system and an engine using them.

BACKGROUND ART

In an internal combustion engine, generally known ignition systems for ignition of an air-fuel mixture includes an ignition system having an auxiliary electrode apart from main electrodes.

For example, such an ignition system having the auxiliary electrode has been conventionally proposed, which includes a center electrode and a ground electrode as an electrical configuration for discharging, and a microwave radiation antenna as an electrical configuration for introducing and radiating a microwave (for example, see Patent Document 1).

Also, another ignition system is known, which includes a negative electrode for an electric discharge, and a first positive electrode and a second positive electrode respectively having different inter-electrode distances relative to the negative electrode. In such a configuration, a voltage is applied between the negative electrode and the first positive electrode having a shorter inter-electrode distance so as to detect the electric discharge, then a voltage is applied between the negative electrode and the second positive electrode having a longer inter-electrode distance. Thus, the discharge can be performed between the long inter-electrode distance from the negative electrode to the second positive electrode (for example, see Patent Document 2).

Furthermore, another ignition system is proposed, which includes a high-voltage main electrode and a main ground electrode to perform an arc discharge, and auxiliary electrodes to generate, before performing the arc discharge, a plasma atmosphere in a discharge region (for example, see Patent Document 3).

PRIOR ART REFERENCE

Patent Documents

[Patent Document 1] JP 2009-038026 A
[Patent Document 2] JP H05-272441 A
[Patent Document 3] JP 2007-032349 A

SUMMARY OF THE INVENTION

Problem to be Solved by the Invention

However, in the conventional ignition system described in Patent Document 1, the electrical configuration for generating the microwave is required apart from the electrical configuration for discharging. Thus, the entire system should be complicated.

Also, in the conventional ignition systems described in Patent Documents 2 and 3, the timing when the voltage is applied to the main electrode is different from the timing when the voltage is applied to the auxiliary electrode. Thus, the effect of the electric field cannot be used, which results in insufficient reduction of a required voltage. Furthermore, on the periphery of a flame kernel, there is an electrode structure that causes cooling loss, which prevents a smooth growth of the flame.

The present invention was made in consideration of the above problems, an object of which is to provide: an engine ignition system and an ignition plug that can reduce the required voltage and that can improve both ignition performance and combustibility (a flame propagation speed); and an engine using them.

Means for Solving Problems

In order to resolve the above-described problems, an ignition system according to the present invention, which is configured to generate a spark discharge by applying a voltage to a gap formed by a center electrode and a ground electrode, includes an auxiliary electrode that is disposed separately from the center electrode and to which is applied a voltage having a same polarity as or a reverse polarity to the center electrode. A voltage that is equal to or lower than the voltage applied between the center electrode and the ground electrode and that generates no spark discharge is applied to the auxiliary electrode. The auxiliary electrode is positioned in such a manner that an electric field generated by the applied voltage between the auxiliary electrode and the ground electrode or between the auxiliary electrode and the center electrode is spread over the gap. A period of time for applying the voltage to the auxiliary electrode is controlled so as to include a period of time for applying the voltage between the center electrode and the ground electrode.

In the above-described ignition system, the auxiliary electrode may be disposed in a position where a distance from the center electrode and a distance from the ground electrode are respectively longer than a distance of the gap between the ground electrode and the center electrode, and a voltage applied between the center electrode and the auxiliary electrode or between the ground electrode and the auxiliary electrode may be applied earlier than or simultaneously with the voltage applied between the ground electrode and the center electrode.

In the above-described ignition system, the auxiliary electrode may be disposed in a position where the distance from the ground electrode is longer than the distance of the gap between the ground electrode and the center electrode. The voltage applied to the auxiliary electrode may be supplied from a voltage supply source for the voltage applied to the center electrode. The voltage having a same potential may be applied simultaneously to the center electrode and to the auxiliary electrode.

In the above-described ignition system, the auxiliary electrode may be disposed in the position where the distance from the center electrode is longer than the distance of the gap between the ground electrode and the center electrode. The center electrode may have a reverse polarity to the polarity of the auxiliary electrode. The voltage applied to the center electrode may be applied between the center electrode and the ground electrode, and between the center electrode and the auxiliary electrode.

In order to resolve the above-described problems, an ignition plug according to the present invention is an ignition plug used in the above-described ignition system, in which the center electrode and the auxiliary electrode have the same potential, and in which the auxiliary electrode is disposed in the position where the distance from the ground electrode to the auxiliary electrode is longer than the distance of the gap between the ground electrode and the center electrode and where the electric field generated by the applied voltage is spread over the gap.

In the above-described ignition plug, the auxiliary electrode may be branched from the center electrode so as to have the same potential as that of the center electrode.

In the above-described ignition plug, an electric discharge conductor may be divided into two branches, and the center electrode and the auxiliary electrode may be provided on the respective electric discharge conductors so that the center electrode and the auxiliary electrode have the same potential.

In the above-described ignition plug used in the above-described ignition system, the electric discharge conductor for the center electrode and the electric discharge conductor for the auxiliary electrode may be individually provided. In this case, the auxiliary electrode may be disposed in the position where the distance from the center electrode to the auxiliary electrode is longer than the distance of the gap between the ground electrode and the center electrode, and where the electric field generated by the applied voltage is spread over the gap. Also, the auxiliary electrode may be disposed in the position where the distance from the ground electrode to the auxiliary electrode is longer than the distance of the gap between the ground electrode and the center electrode, and where the electric field generated by the applied voltage is spread over the gap.

In order to resolve the above problems, an engine according to the present invention includes the above ignition system.

EFFECTS OF THE INVENTION

In the present invention, separately from the center electrode, the auxiliary electrode is provided, to which is applied the voltage having the same polarity as or the reverse polarity to the center electrode. The voltage that is equal to or lower than the voltage applied between the center electrode and the ground electrode and that generates no spark discharge is applied to the auxiliary electrode. The auxiliary electrode is positioned in such a manner that the electric field generated by the applied voltage between the auxiliary electrode and the ground electrode or between the auxiliary electrode and the center electrode is spread over the gap. The period of time for applying the voltage to the auxiliary electrode is controlled so as to include the period of time for applying the voltage between the center electrode and the ground electrode. Thus, the spark discharge from the center electrode to the ground electrode is performed while the electric field is generated by the auxiliary electrode. As a result, it is possible to reduce the required voltage for the center electrode at the time of the spark discharge, which improving the ignition performance. At the same time, it is possible to promptly transfer the (charged) flame kernel from a spark gap structure having a large cooling loss so as to improve the combustion limit. Also, the flame propagation speed after ignition can be improved.

BRIEF DESCRIPTION OF DRAWINGS

FIG. 7(*a*) indicates the relationship between the applied voltage to the auxiliary electrode and a pressure in a cylinder. FIG. 7(*b*) indicates the relationship between the applied voltage to the auxiliary electrode and a required voltage. FIGS. 7(*c*) to 7(*e*) indicate the relationship between a discharge duration and the required voltage respectively in the states A, B and C in FIGS. 7(*a*) and 7(*b*).

MODES FOR CARRYING OUT THE INVENTION

Hereinafter, embodiments of the present invention will be described with reference to the drawings.

Figure 1:
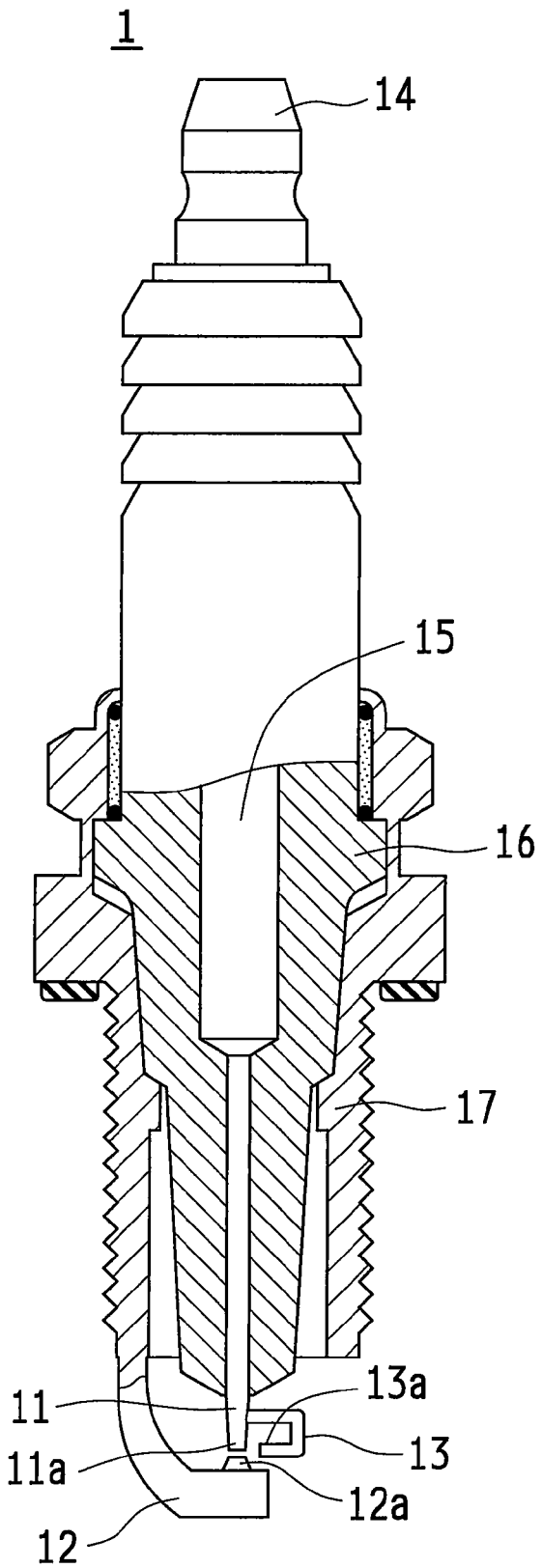
FIG. 1 is a partial cross-sectional view schematically illustrating an entire configuration of an ignition plug according to the present invention.
Figure 2:
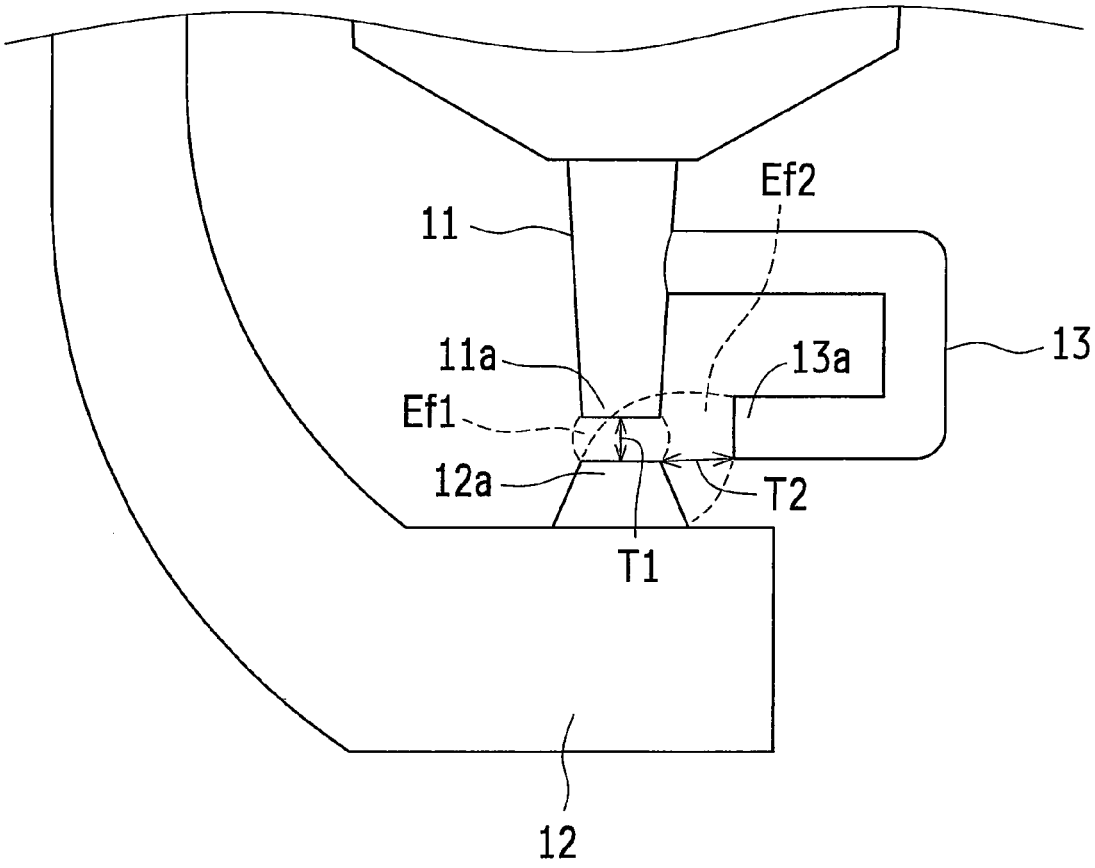
FIG. 2 is a partial enlarged view illustrating an electrode portion of the ignition plug shown in FIG. 1.
Figure 3:
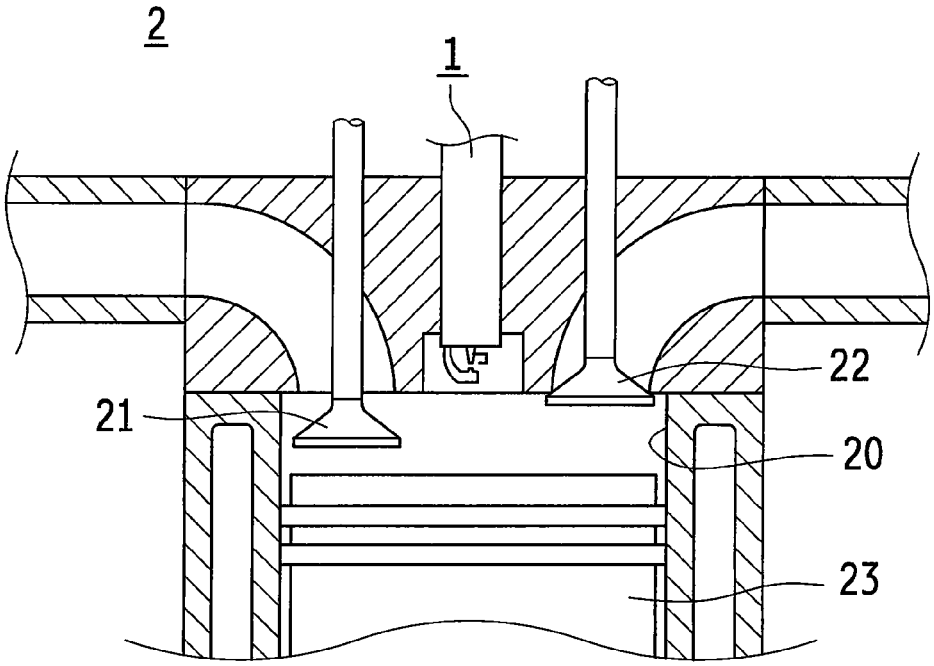
FIG. 3 is a partial cross-sectional view illustrating an engine according to the present invention.
Figure 4:
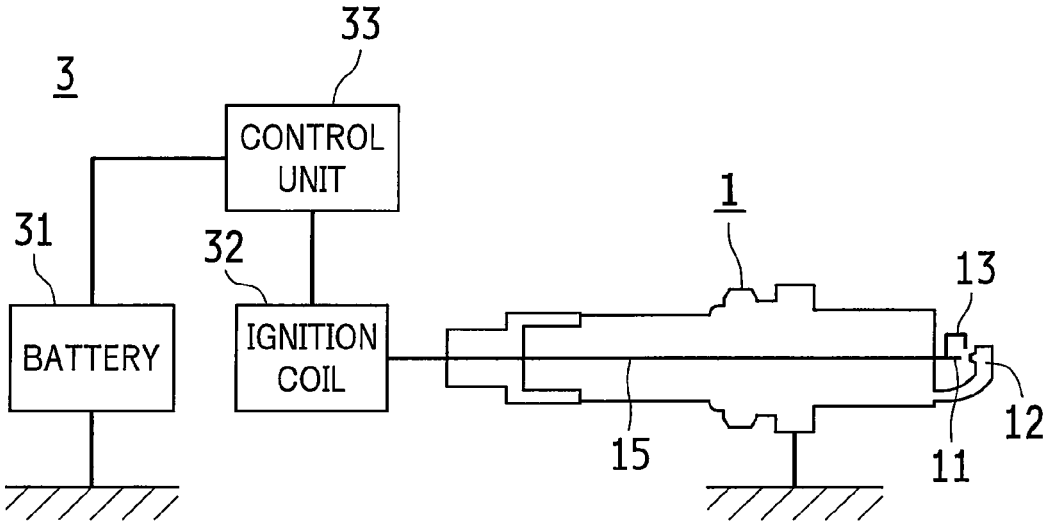
FIG. 4 is a block diagram schematically illustrating an entire configuration of an ignition system according to the present invention.

FIGS. 1 and 2 show an ignition plug 1 according to the present invention. FIG. 3 shows an engine 2 using the ignition plug 1. FIG. 4 shows an ignition system 3 using the ignition plug 1.

The ignition plug 1 according to the present invention is configured to generate a spark discharge by applying a voltage between a center electrode 11 and a ground electrode 12. An auxiliary electrode 13 is branched from the center electrode 11 so as to be disposed in a position where a distance T2 from the ground electrode 12 to the auxiliary electrode 13 is longer than a distance T1 of a gap from the ground electrode 12 to the center electrode 11.

The ignition plug 1 applies the voltage from a voltage terminal 14 to the center electrode 11 via an electric discharge conductor 15. An outer periphery of the electric discharge conductor 15 is protected by an insulator 16. On the lower half of the insulator 16, on the side of the center electrode 11, a main body metal fitting 17 including the ground electrode 12 is provided. The spark discharge is performed in the gap between the ground electrode 12 and the center electrode 11.

The center electrode 11 is electrically connected to the voltage terminal 14 via the electric discharge conductor 15. The center electrode 11 protrudes from the substantial center of one end of the ignition plug 1.

The ground electrode 12 is provided to stand from a rim of the main body metal fitting 17 and bent substantially orthogonally so that a tip 12*a* thereof is positioned directly above the center electrode 11. The discharge is performed in the gap between the tip 12*a* of the ground electrode 12 and a tip 11*a* of the center electrode 11.

The auxiliary electrode 13 is branched from a base end portion of the center electrode 11. The auxiliary electrode 13 is formed so as to have a substantially U-shape. That is, the auxiliary electrode 13 is extended from the base end portion of the center electrode 11 in the direction away from the center electrode 11, then bent in the same direction as the direction of the tip of the center electrode 11, and further bent, in the vicinity of the tip 11*a* of the center electrode 11, in the direction close to the center electrode 11. Thus, a tip 13*a* of the auxiliary electrode 13 faces the gap between the center electrode 11 and the ground electrode 12. The auxiliary electrode 13 may be integrally formed with the center electrode 11, or may be welded and fixed to the center electrode 11.

The distance T2 between the tip 13*a* of the auxiliary electrode 13 and the tip 12*a* of the ground electrode 12 is longer than the distance T1 of the gap between the tip 11*a* of the center electrode 11 and the tip 12*a* of the ground electrode 12. Since the auxiliary electrode 13 is branched from the center electrode 11, the voltage having the same potential is applied to the center electrode 11 and to the auxiliary electrode 13.

In this case, when an electric field intensity (V/T1) of an electric field Ef1 at the center electrode 11 is compared with an electric field intensity (V/T2) of an electric field Ef2 (hereinafter, this electric field is referred to as an auxiliary electric field) at the auxiliary electrode 13, the electric field intensity (V/T1) of the center electrode 11 is larger than the electric field intensity (V/T2) of the auxiliary electrode 13, because the distance T2 is longer than the distance T1. The respective distances T1 and T2 are set so that the electric field intensity (V/T2) of the auxiliary electrode 13 is smaller than the electric field intensity (Es) required for the spark discharge and that the electric field intensity (V/T1) of the center electrode 11 is equal to or larger than the electric field intensity (Es) required for the spark discharge (i.e., V/T1≥Es>V/T2).

Also, the auxiliary electric field Ef2 is provided in a position where it is spread over the gap between the center electrode 11 and the ground electrode 12. The auxiliary electric field Ef2 can be simulated by the shape of the auxiliary electrode 13 and the voltage applied to the auxiliary electrode 13. Thus, the position where the auxiliary electric field Ef2 is spread over the gap between the center electrode 11 and the ground electrode 12 may be the position where the auxiliary electric field Ef2 is partially overlapped with the electric field Ef1 simulated by the voltage applied to the center electrode 11.

The auxiliary electrode 13 is formed so as to have the substantially U-shape. However, the shape of the auxiliary electrode 13 is not limited to the U-shape, provided that the distance T2 between the tip 13*a* and the tip 12*a* of the ground electrode 12 is longer than the distance T1 of the gap between the tip 11*a* of the center electrode 11 and the tip 12*a* of the ground electrode 12, and that the auxiliary electric field Ef2 is provided in the position where it is spread over the gap between the center electrode 11 and the ground electrode 12. For example, the auxiliary electrode 13 may have a substantially L-shape formed by being extended from the base end portion of the center electrode 11 in the direction away from the center electrode 11, then bent in the same direction as the direction of the tip of the center electrode 11. Also, the auxiliary electrode 13 may have a linear shape formed by being obliquely extended from the base end portion of the center electrode 11.

As shown in FIG. 3, the ignition plug 1 having the above-described configuration is attached, similarly to a general spark plug, to the engine 2. FIG. 3 shows a cylinder 20, an intake valve 21, an exhaust valve 22 and a piston 23.

As shown in FIG. 4, the ignition plug 1 is ignited by the general ignition system 3. The ignition system 3 is configured such that the voltage of electricity from a battery 31 is increased by an ignition coil 32 and then applied to the ignition plug 1 by a control unit 33.

In the ignition plug 1 to which the voltage is applied by the ignition system 3, the auxiliary electrode 13 is branched from the center electrode 11. Thus, the voltage having the same potential is applied to the center electrode 11 and to the auxiliary electrode 13 at the timing when the voltage is applied to the center electrode 11.

At this time, the auxiliary electric field Ef2 is generated, by the applied voltage to the auxiliary electrode 13, in the vicinity of the gap between the center electrode 11 and the ground electrode 12. Thus, when the voltage having the same potential is applied to the center electrode 11, the spark discharge is easily performed. That is, since the auxiliary electric field Ef2 having a certain electric field intensity (V/T2) exists in the vicinity of the gap between the center electrode 11 and the ground electrode 12, the electric field Ef1 by the voltage applied to the center electrode 11 is coupled with the above-described auxiliary electric field Ef2 so as to easily exceed the electric field intensity (Es) required for the spark discharge. The distance T1 is set so that the electric field intensity (V/T1) itself of the electric field Ef1 by the voltage applied to the center electrode 11 is equal to or larger than the electric field intensity (Es) required for the spark discharge. Therefore, with the electric field intensity (V/T2) of the auxiliary electric field Ef2 added to the above, the electric field intensity easily exceeds the electric field intensity (Es) required for the spark discharge even when the sufficient voltage is not applied. Accordingly, with the ignition plug 1, it is possible to reduce the required voltage to obtain the electric field intensity (Es) required for the spark discharge.

Since the required voltage to obtain the electric field intensity (Es) required for the spark discharge can be reduced, when the voltage is sufficiently applied, a strong spark discharge can be obtained for a long period of time by the excess amount of the voltage. Therefore, by the use of the ignition plug 1, it is possible to enhance the growth of the flame kernel during initial combustion so as to improve ignition performance, and further it is possible to promptly transfer the (charged) flame kernel from a spark gap structure having a large cooling loss so as to improve the lean combustion limit. Furthermore, the flame propagation speed after ignition can also be improved.

In the ignition plug 1, only the voltage having the same potential as that to be applied to the center electrode 11 is applied to the auxiliary electrode 13 without any special ignition system 3. Accordingly, in order to obtain the configuration of the present invention, it is sufficient to replace the existing plug used in the engine 2 with the ignition plug 1.

Figure 5:
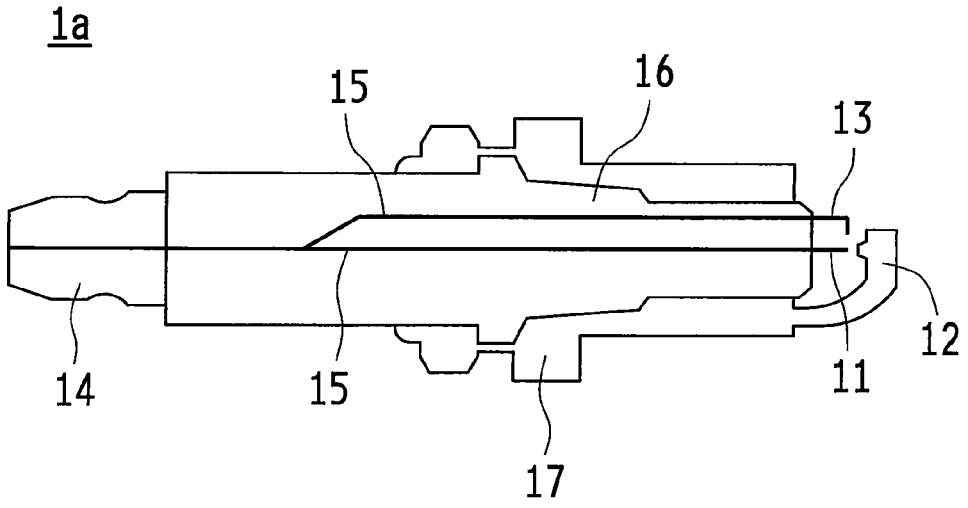
FIG. 5 is a schematic view illustrating a configuration of the ignition plug according to another embodiment of the present invention.

FIG. 5 shows an ignition plug 1*a* according to another embodiment of the present invention.

In the ignition plug 1*a*, the electric discharge conductor 15 from the voltage terminal 14 is divided into two branches, and on the respective end portions of the branched electric discharge conductors 15 and 15, the center electrode 11 and the auxiliary electrode 13 are provided. The relationship between the distances T1 and T2 of the center electrode 11, the ground electrode 12 and the auxiliary electrode 13 are the same as in the case of the above-described ignition plug 1.

The ignition plug 1*a* is obtained by only changing the configuration of the ignition plug 1 in which the auxiliary electrode 13 is branched from the center electrode 11 to the configuration of the electric discharge conductor 15 to be divided into two branches. Accordingly, the ignition plug 1*a* can be used similarly to the above-described ignition plug 1 so as to obtain the same function and effect.

Figure 6:
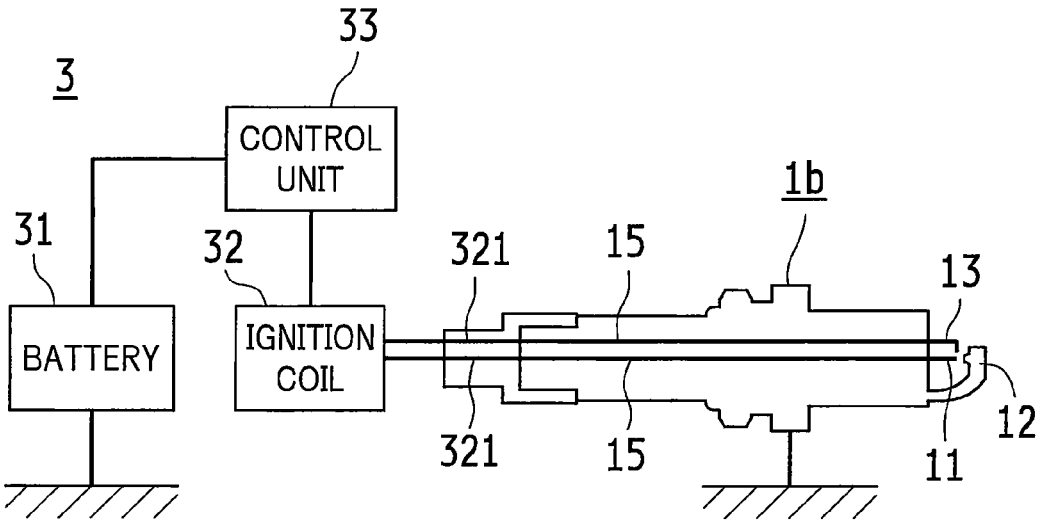
FIG. 6 is a block diagram schematically illustrating an entire configuration of the ignition system using the ignition plug according to another configuration of the present invention.

FIG. 6 shows an ignition plug 1*b* and the ignition system 3 for operating the ignition plug 1*b* according to another configuration of the present invention.

In the ignition plug 1*b*, the electric discharge conductor 15 for the center electrode 11 and the electric discharge conductor 15 for the auxiliary electrode 13 are provided independently from each other. The ignition coil 32 to apply the voltage to the ignition plug 1*b* has two terminal cables 321 and 321 corresponding to the two electric discharge conductors 15 and 15. The relationship between the distances T1 and T2 of the center electrode 11, the ground electrode 12 and the auxiliary electrode 13 are the same as in the case of the above-described ignition plug 1.

Similarly to the above-described ignition plug 1, the ignition plug 1*b* may apply, by the ignition system 3, the voltage having the same potential from the terminal cables 321 and 321 to the center electrode 11 and the auxiliary electrode 13 via the respective electric discharge conductors 15 and 15. In this case, the same function and effect as those by the ignition plug 1 can be obtained.

The ignition system 3 is provided with the ignition coil 32 having the two terminal cables 321 and 321 corresponding to the two electric discharge conductors 15 and 15 of the ignition plug 1*b*. Thus, the voltage applied to the center electrode 11 and that to the auxiliary electrode 13 by the ignition system 3 may be different. In this case, the voltage is applied to the auxiliary electrode 13 not for the spark discharge but for generation of the auxiliary electric field Ef2 to assist the spark discharge generated by the voltage applied to the center electrode 11. Therefore, to the auxiliary electrode 13, the same voltage as the voltage to the center electrode 11 is applied when the center electrode 11 and the auxiliary electrode 13 are configured to have the same potential, or the voltage lower than the voltage to the center electrode 11 is applied.

Note that the auxiliary electric field Ef2 for assisting the spark discharge should be generated when the voltage is applied to the center electrode 11. Thus, the period of time for applying the voltage to the auxiliary electrode 13 is controlled so as to include the period of time for applying the voltage to the center electrode 11. For example, the voltage may simultaneously be applied to the center electrode 11 and to the auxiliary electrode 13 at the timing of the spark discharge. Or the voltage may be applied to the center electrode 11 at the timing of the spark discharge under the condition in which the voltage is continuously applied to the auxiliary electrode 13.

For the purpose of assisting the spark discharge generated by the voltage applied to the center electrode 11, if the voltage applied to the auxiliary electrode 13 is too low, the auxiliary electric field Ef2 having the sufficient electric field intensity cannot be obtained. Therefore, the voltage applied to the auxiliary electrode 13 should be set so as to obtain the electric field intensity sufficient to assist the spark discharge generated by the voltage applied to the center electrode 11.

Setting of the voltage will be described with reference to FIG. 7.

Figure 7:
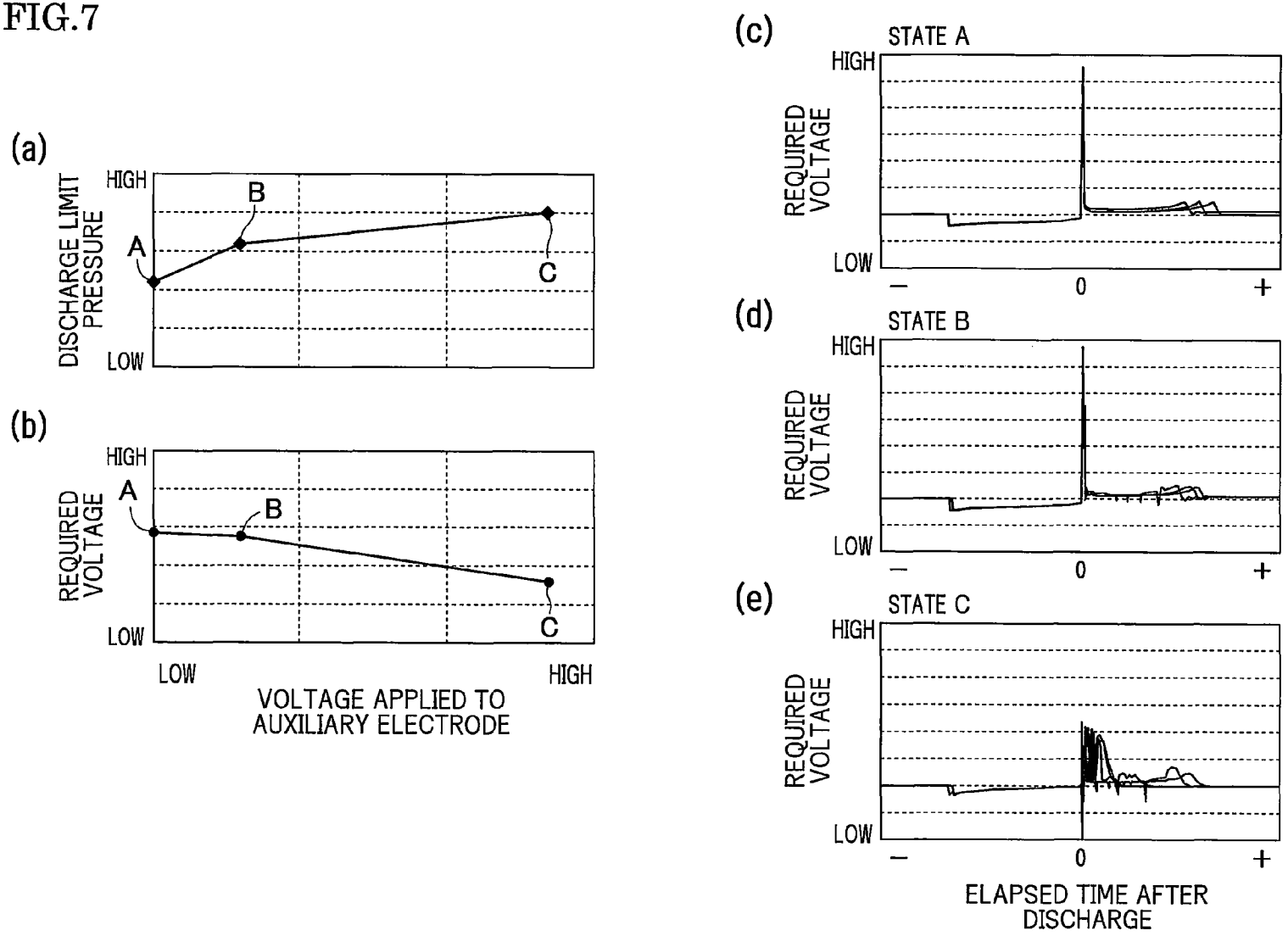
FIGS. 7(*a*) to 7(*e*) are graphs for explaining setting of a voltage to be applied to an auxiliary electrode in the present invention.

FIGS. 7(*a*) and 7(*b*) each show the variation of the voltage (required voltage) necessary for the spark discharge of the center electrode 11 and the variation of the discharge limit pressure in the cylinder 20 of the engine 2 when the different voltages are applied to the auxiliary electrode 13. FIGS. 7(*c*) to 7(*e*) each show the discharge state when the corresponding voltage is applied to the auxiliary electrode 13.

That is, when the voltage applied to the auxiliary electrode 13 is low as shown in states A and B in FIG. 7(*b*), although the spark discharge is generated by the center electrode 11 as shown in FIGS. 7(*c*) and 7(*d*), the voltage (required voltage) necessary for the spark discharge is high and the spark discharge is momentary. Thus, it can be seen that the electric field intensity of the auxiliary electric field Ef2 generated by the voltage applied to the auxiliary electrode 13 does not assist the spark discharge generated by the voltage applied to the center electrode 11. On the other hand, when the voltage applied to the auxiliary electrode 13 is high as shown in a state C in FIG. 7(*b*), the spark discharge by the center electrode 11 is generated as shown in FIG. 7(*e*) despite the voltage (required voltage) lower than that in the states A and B, and the spark discharge continues for a longer period of time. This shows that the auxiliary electric field Ef2 generated by the voltage applied to the auxiliary electrode 13 assists the spark discharge generated by the voltage applied to the center electrode 11. As can be seen from the graph of FIG. 7(*e*), the required voltage for the spark discharge is low and the spark discharge continues for a long period of time compared with the graphs of the states A and B shown in FIGS. 7(*c*) and 7(*d*). Also, as shown in FIG. 7(*a*), when the respective discharge limit pressures in the cylinder in the states A, B and C are compared with one another, the pressure is higher in the state C than in the states A and B. This shows that sufficient combustion of fuel gas in the cylinder results in the higher pressure, which proves improvement of combustion efficiency.

Figure 8:
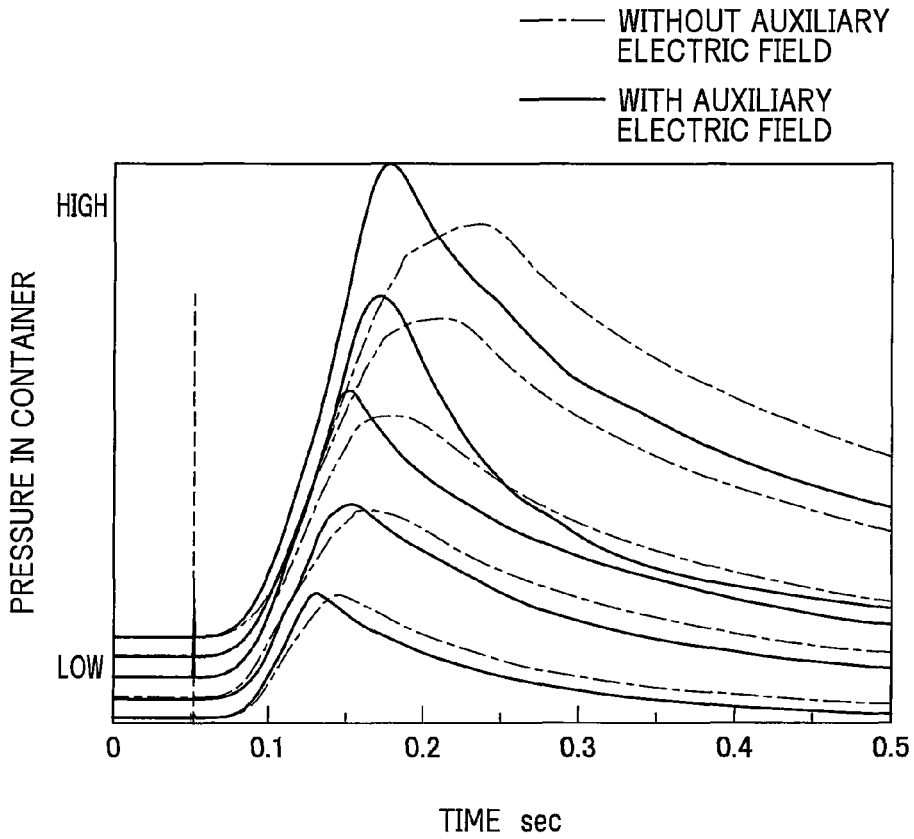
FIG. 8 is a graph indicating variations of the pressure in the cylinder with or without an auxiliary electric field in the respective pressure states of the engine.

The discharge limit pressure in the cylinder varies depending on an operating environment, a load during the operation or a rotational speed of the engine 2. Thus, different pressure states were reproduced in a container assumed to be the cylinder 20 of the engine 2 so as to generate the spark discharge by the center electrode 11 when the auxiliary electric field Ef2 was provided and when it was not provided, and the respective discharge limit pressures in the container were compared. As shown in FIG. 8, in any pressure states, it was confirmed that the spark discharge with the auxiliary electric field Ef2 could obtain the high pressure in the container compared with the spark discharge without the auxiliary electric field Ef2, which resulted in the improvement of the combustion efficiency. Therefore, when the voltage applied to the auxiliary electrode 13 is controlled separately from the voltage applied to the center electrode 11, the control is performed so that the voltage sufficient to obtain the auxiliary electric field Ef2 that can assist the spark discharge can be applied as shown in FIG. 7, and that the effective voltage in each of the different pressure states that varies depending on the season or the load can be applied as shown in FIG. 8. The control unit 33 can perform the control.

In the ignition plug 1*b* shown in FIG. 6, the relationship between the distances T1 and T2 of the center electrode 11, the ground electrode 12 and the auxiliary electrode 13 is configured similarly to the relationship in the above-described ignition plug 1. However, in the ignition plug 1*b*, control can be performed by the ignition system 3, as described above, so that the voltage applied to the center electrode 11 is different from the voltage applied to the auxiliary electrode 13. Thus, in the case where the ignition system 3 controls the voltage applied to the center electrode 11 and that to the auxiliary electrode 13, the distance T2 between the auxiliary electrode 13 and the ground electrode 12 is not needed to be longer than the distance T1 between the center electrode 11 and the ground electrode 12. In this regard, however, the auxiliary electrode 13 should be positioned in such a manner that the auxiliary electric field Ef2 is provided in the position where it is spread over the gap between the center electrode 11 and the ground electrode 12 so that the electric field Ef1 by the center electrode 11 is coupled with the auxiliary electric field Ef2 and assists the spark discharge by the center electrode 11.

In this case, the position where the auxiliary electric field Ef2 is spread over the gap between the center electrode 11 and the ground electrode 12 is the same as the position in the above-described ignition plug 1. The auxiliary electric field Ef2 can be simulated by the shape of the auxiliary electrode 13 and the voltage applied to the auxiliary electrode 13. Thus, the position where the auxiliary electric field Ef2 is spread over the gap between the center electrode 11 and the ground electrode 12 may be the position where the auxiliary electric field Ef2 is partially overlapped with the electric field Ef1 simulated by the voltage applied to the center electrode 11.

Figure 9:
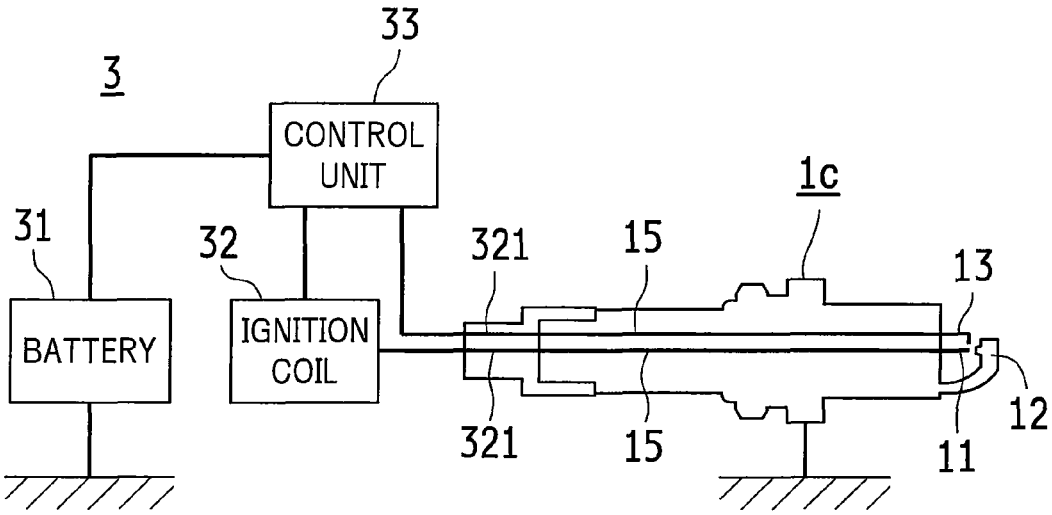
FIG. 9 is a block diagram schematically illustrating an entire configuration of the ignition system according to another configuration of the present invention.
Figure 10:
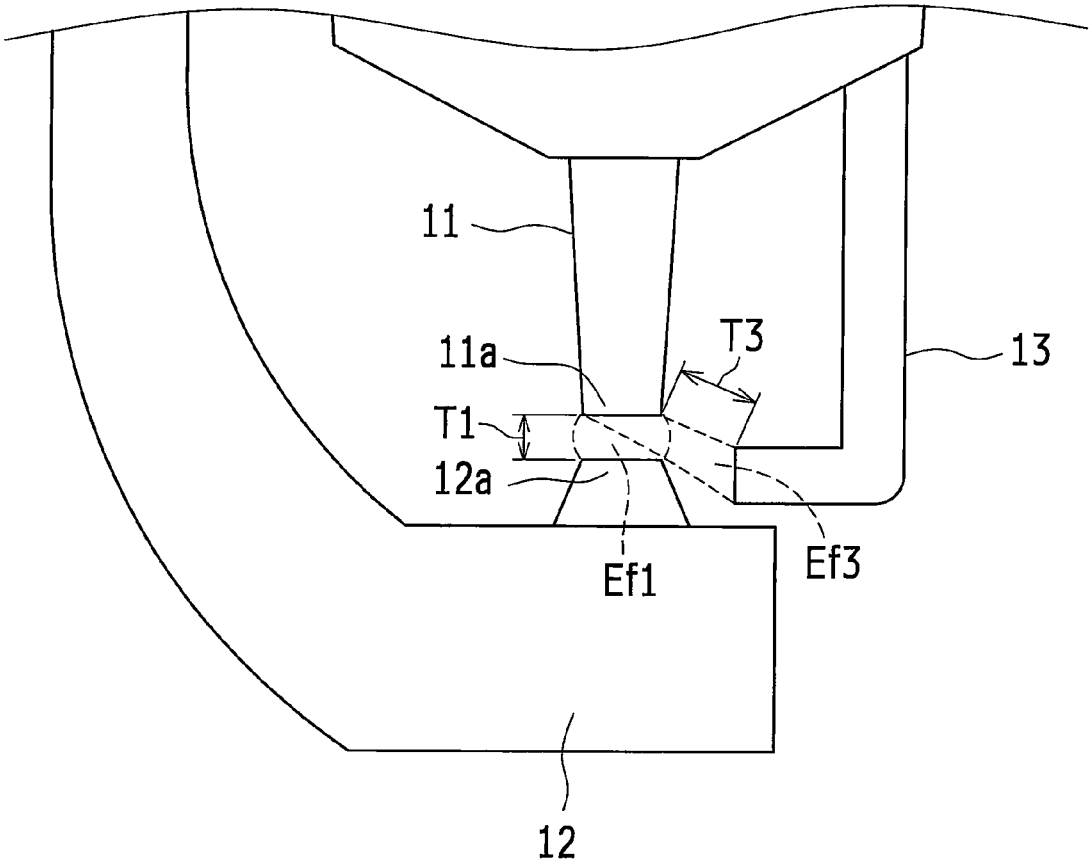
FIG. 10 is a partial enlarged view illustrating an electrode portion of the ignition plug shown in FIG. 9.

FIG. 9 shows the ignition system 3 according to another embodiment of the present invention. FIG. 10 shows an ignition plug 1*c* used in the ignition system 3.

That is, the ignition system 3 is changed to apply to auxiliary electrode 13 the voltage having a reverse polarity to the center electrode 11 from the configuration of the ignition system 3 shown in FIG. 6 in which the voltage having the same polarity as the center electrode 11 is applied to the auxiliary electrode 13. Thus, an auxiliary electric field Ef3 is generated between the center electrode 11 and the auxiliary electrode 13 for assisting the spark discharge. Here, only the differences from the ignition system 3 shown in FIG. 6 will be described. The same elements have the same reference numerals, and the description is omitted. In the ignition system 3, when the negative voltage is applied, for example, to the center electrode 11, the positive voltage is applied to the auxiliary electrode 13. Since the voltage is applied to the auxiliary electrode 13 to assist the spark discharge, the timing to apply the voltage to the auxiliary electrode 13 is the same as or earlier than the timing to apply the voltage to the center electrode 11.

In the ignition plug 1*c*, a distance T3 between the tip 13*a* of the auxiliary electrode 13 and the tip 11*a* of the center electrode 11 is longer than the distance T1 of the gap between the tip 11*a* of the center electrode 11 and the tip 12*a* of the ground electrode 12.

The auxiliary electrode 13 is provided so that the distance T3 to the center electrode 11 is longer than the distance T1 from the center electrode 11 to the ground electrode 12. Meanwhile, to the auxiliary electrode 13 is applied the voltage having the reverse polarity to the center electrode 11, thus a potential difference (V+ΔV) between the center electrode 11 and the auxiliary electrode 13 is larger than a potential difference (V) between the center electrode 11 and the ground electrode 12 by the difference (ΔV) in the potential between the ground electrode 12 and the auxiliary electrode 13. Under this condition, the respective T1 and T3, and the voltage applied to the auxiliary electrode 13 are set so that the electric field intensity (V/T1) of the electric field Ef1 generated by the center electrode 11 is equal to or larger than the electric field intensity (Es) required for the spark discharge and that the electric field intensity ((V+ΔV)/T3) of the electric field Ef3 generated by the auxiliary electrode 13 is smaller than the electric field intensity (Es) required for the spark discharge (i.e., V/T1≥Es>(V+ΔV)/T3).

Also, the auxiliary electric field Ef3 is provided in a position where it is spread over the gap between the center electrode 11 and the ground electrode 12. The auxiliary electric field Ef3 can be simulated by the shape of the auxiliary electrode 13 and the voltage applied to the auxiliary electrode 13 and the center electrode 11. Thus, the position where the auxiliary electric field Ef3 is spread over the gap between the center electrode 11 and the ground electrode 12 may be the position where the auxiliary electric field Ef3 is partially overlapped with the electric field Ef2 simulated by the voltage applied to the center electrode 11.

In the ignition system 3, the auxiliary electric field Ef3 is generated, by the voltage applied between the center electrode 11 and the auxiliary electrode 13, in the vicinity of the gap between the center electrode 11 and the ground electrode 12. Thus, the auxiliary electric field Ef3 is coupled with the electric field Ef1 generated by the voltage applied to the center electrode 11 so as to easily exceed the electric field intensity (Es) required for the spark discharge, thereby obtaining the same function and effect as those of the above-described ignition system 3 shown in FIG. 6.

In the ignition system 3 of the present embodiment, the ignition plug 1*c* is provided so that the distance T3 between the auxiliary electrode 13 and the center electrode 11 is longer than the distance T1 of the gap between the center electrode 11 and the ground electrode 12. In addition to the above condition, the ignition plug 1*c* may be provided so that the distance T2 between the auxiliary electrode 13 and the ground electrode 12 is longer than the distance T1 of the gap between the center electrode 11 and the ground electrode 12.

In this case, depending on the operating condition, the ignition system 3 may be used as a configuration applying to the auxiliary electrode 13 the voltage having the same polarity as the center electrode 11 as shown in FIG. 6, or may be used as a configuration applying to the auxiliary electrode 13 the voltage having the reverse polarity to the center electrode 11 as shown in FIG. 9.

The engine 2 including the ignition system 3 having the ignition plug 1, 1*a*, 1*b* or 1*c* configured as described above is not limited thereto. The present invention can be applied to various types of engines 2 using the above kinds of ignition plugs. Since the lean combustion limit can be improved, the fuel-efficient engine 2 can be realized. Also, due to good combustion efficiency, it is possible to use the engine 2 in areas where a fuel purification technology is not developed and thus there is a variation in the fuel intensity of produced fuel.

INDUSTRIAL APPLICABILITY

The ignition system and the ignition plug according to the present invention may also be applied, apart from the engine, to various ignition systems requiring ignition by the spark discharge.

The present invention may be embodied in other forms without departing from the gist or essential characteristics thereof. The foregoing embodiment is therefore to be considered in all respects as illustrative and not limiting. The scope of the invention is indicated by the appended claims rather than by the foregoing description, and all modifications and changes that come within the meaning and range of equivalency of the claims are intended to be embraced therein.

DESCRIPTION OF REFERENCE NUMERALS

1 Ignition plug
1*a* Ignition plug
1*b* Ignition plug
1*c* Ignition plug
11 Center electrode
12 Ground electrode
13 Auxiliary electrode
15 Electric discharge conductor
2 Engine
3 Ignition system
T1 Distance
T2 Distance
T3 Distance
Ef2 Electric field (auxiliary electric field)
Ef3 Electric field (auxiliary electric field)

The invention claimed is:

1. An ignition system configured to generate a spark discharge by applying a voltage to a gap formed by a center electrode and a ground electrode, the ignition system comprising:

an auxiliary electrode being disposed separately from the center electrode, the auxiliary electrode to which is applied a voltage having a reverse polarity to the center electrode, wherein a voltage that is equal to or lower than the voltage applied between the center electrode and the ground electrode and that generates no spark discharge is applied to the auxiliary electrode, wherein the auxiliary electrode is positioned in such a manner that an electric field generated by the applied voltage between the auxiliary electrode and the ground electrode or between the auxiliary electrode and the center electrode is spread over the gap, wherein a period of time for applying the voltage to the auxiliary electrode is controlled so as to include a period of time for applying the voltage between the center electrode and the ground electrode, wherein the auxiliary electrode is disposed in a position where a distance from the center electrode is longer than a distance of the gap between the ground electrode and the center electrode, and wherein the voltage applied to the center electrode is applied between the center electrode and the ground electrode, and between the center electrode and the auxiliary electrode.

2. The ignition plug used in the ignition system according to claim 1, wherein an electric discharge conductor for the center electrode and an electric discharge conductor for the auxiliary electrode are individually provided, and wherein the auxiliary electrode is disposed in the position where the distance from the center electrode to the auxiliary electrode is longer than the distance of the gap between the ground electrode and the center electrode, and where the electric field generated by the applied voltage is spread over the gap.

3. An engine comprising the ignition system according to claim 1.

4. An engine comprising the ignition plug according to claim 2.

* * * * *